7/29/85 XR 4,602,437

United States Patent [19]

Berthiaume

[11] Patent Number: 4,602,437

[45] Date of Patent: Jul. 29, 1986

[54] ARCHERY SIGHT

[76] Inventor: Ronald Berthiaume, R.D. 1, Salisbury, Vt. 05769

[21] Appl. No.: 700,242

[22] Filed: Feb. 11, 1985

[51] Int. Cl.[4] ..... F41G 1/46

[52] U.S. Cl. ..... 33/265; 33/248

[58] Field of Search ..... 33/248, 265, 245, 247, 33/257, 281, 292

[56] References Cited

U.S. PATENT DOCUMENTS

| | | | |
|---|---|---|---|
| 1,609,789 | 12/1926 | Belding | 33/248 |
| 2,224,783 | 12/1940 | Gibbs | 33/248 |
| 2,351,103 | 6/1944 | Brown | 33/265 |
| 2,500,509 | 3/1950 | Bailey . | |
| 2,645,855 | 7/1953 | Ivy | 33/248 |
| 2,782,511 | 2/1957 | Ivy | 33/248 |
| 2,814,284 | 11/1957 | Sileo . | |
| 3,365,800 | 1/1968 | Carella . | |
| 3,455,027 | 7/1969 | Perkins . | |
| 3,696,517 | 10/1972 | Larson . | |
| 3,798,783 | 3/1974 | Carella . | |
| 3,811,195 | 5/1974 | Carella . | |
| 4,048,726 | 9/1977 | LeFebvre . | |
| 4,136,462 | 1/1979 | Topel . | |
| 4,159,575 | 7/1979 | Kalmbach . | |
| 4,162,579 | 7/1979 | James . | |
| 4,215,485 | 8/1980 | Mesler . | |
| 4,263,718 | 4/1981 | Smith . | |
| 4,291,469 | 9/1981 | Weast . | |
| 4,417,403 | 11/1983 | Strange . | |

*Primary Examiner*—Harry N. Haroian

*Attorney, Agent, or Firm*—Pennie & Edmonds

[57] ABSTRACT

An archery sight providing independent vertical and horizontal orientation of a sighting tube at both front and rear. The sight includes a ball-and-socket-type support for holding each end of the sighting tube so that the two-dimensional movements of each end are independent of any adjustments made to the other end. Each end of the sighting tube is accommodated in a channel which passes through the ball portion of one of the supports.

5 Claims, 5 Drawing Figures

ARCHERY SIGHT

BACKGROUND OF THE INVENTION

1. Field of the Invention

The invention relates to an archery sight, and more particularly to an improved sight of the type that includes a sighting tube.

2. Description of Related Art

A number of issued patents show archery sights using various sighting methods. A bow sight that includes a sighting tube is shown in U.S. Pat. No. 4,048,726 to LeFebvre. A sighting tube that includes telescope elements is seen in U.S. Pat. No. 4,291,469 to Weast. U.S. Pat. No. 4,215,485 to Messler shows a simple bow sight wherein the sighting is done through pairs of holes in sheet metal arms that are essentially fixed. A sighting pin with a bead on one end is shown in U.S. Pat. No. 4,263,718 to Smith.

U.S. Pat. No. 4,417,403 to Strange shows a further bow sight. Attached to the bow by a bracket 12 is an outward-facing mounting bracket 25, which can be canted about its mounting screws 34*a* and 34*b* to trace a somewhat cylindrical surface; that is, either upward and toward the bow, or downward and toward the bow. On the side of the mounting bracket away from the bow is a sight plate 40. At the front end, the sight plate has a front sight 48 with a round tip 52 which projects a variable distance away from the bow for sighting. Pivotally attached to the rear of sight plate 40 is a distance member 60, which pivots in a vertical plane parallel to the bow to adjust its angle to compensate for the distance to the target. Mounted at the end of the distance member toward the archer is a rear sight 74, which includes a ring 86 enclosing cross hairs 88. The Strange sight also compensates for the distance to the target by canting the mounting bracket 25 about its mounting screws 34*a* and 34*b*. When the bracket 25 is at an angle, the sight plate 40 is no longer vertical and no longer parallel to the bow. In this inclined position, when the distance member 60 is adjusted for distance, its motion takes place in a plane that is no longer entirely vertical.

The first four sights mentioned above do not provide for independent two-dimensional front and rear sighting adjustability, which is desirable for simple, fast, and practical archery use.

The Strange bow sight is highly complex, expensive to manufacture, and also lacks independent two-dimensional front and rear adjustability. It based on a system of simultaneously compensating for distance, height, and side-to-side aiming errors that are peculiar to the individual archer. If practical at all, the Strange system appears to be unduly difficult to use.

SUMMARY OF THE INVENTION

The present invention provides independent vertical and horizontal orientation of a sighting tube at both front and rear, which results in fast and convenient sighting. It includes a ball-and-socket support for holding each end of the sighting tube so that its two-dimensional movements are independent of the adjustments made to the other end.

According to one form of the invention, the invention comprises frame means for attachment to a bow, front and rear support means mounted on the frame means, sighting means having front and rear portions respectively supported on the front and rear support means, and adjustment means interconnecting the support means and the frame means for independently selectively orienting the front and rear ends of the sighting means vertically and horizontally with respect to the frame means.

According to a preferred embodiment, the sight includes a vertical mounting plate to be attached, for example, to the left side of a right-handed bow. An integral horizontal mounting plate extends leftward from the vertical mounting plate. Mounted on top of each end of the horizontal mounting plate is an outer housing, which has slotted top and left sides. An inner housing is located within each outer housing, and is attached thereto by means of adjustment screws passing through the slots in the outer housing and into threaded holes in the top and left sides of the inner housing. Each inner housing is held in a selected position within the corresponding outer housing by two nuts that are threaded onto the two adjustment screws and screwed tightly against the outer housing. Each inner housing has an aperture for holding a spherical bearing, which is held in the aperture for rotational movement. Each bearing has a hole extending generally in the front-to-back direction. A sighting tube extends through the holes in the two bearings. A sighting bead is located in the end of the sighting tube away from the archer.

DETAILED DESCRIPTION

Figure 1:
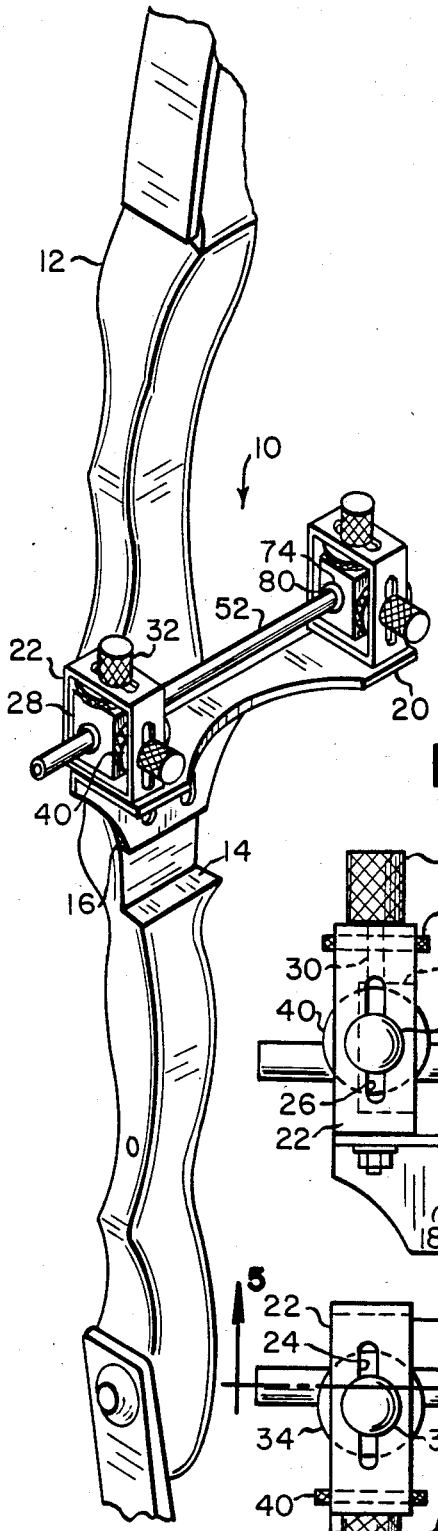
FIG. 1 shows an archery sight according to a preferred embodiment of the invention installed on the left side of a right-hand compound bow (shown in part)
Figure 2:
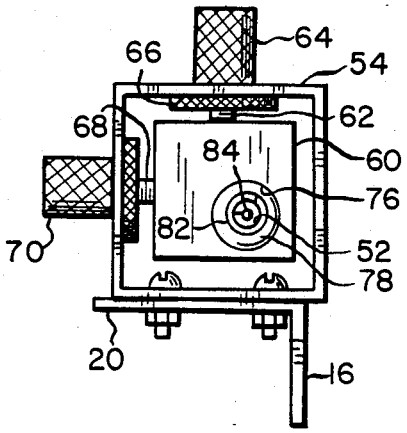
FIG. 2 shows a rear end elevation of the sight.
Figure 3:
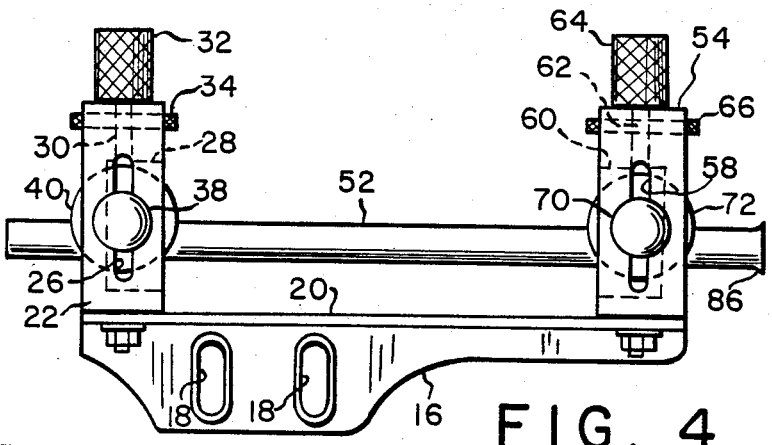
FIG. 3 shows a left side elevation of the sight.
Figure 4:
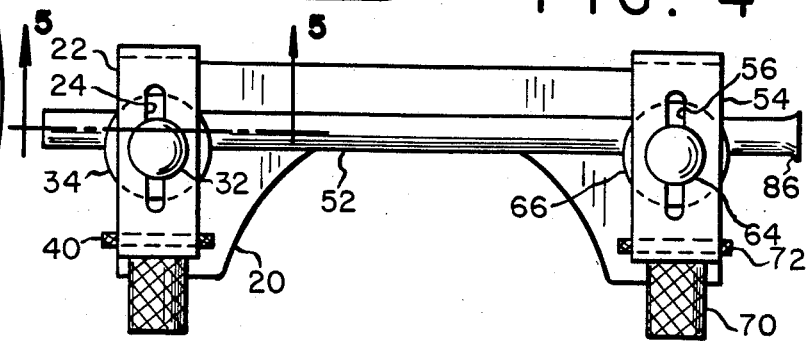
FIG. 4 shows a plan view of the sight.

Referring to FIGS. 1–4, there is seen an archery sight 10 according to a preferred embodiment of the invention, mounted on the left side of a right-hand bow 12 above the arrow rest 14.

The sight includes a vertical mounting plate 16 in which two screw holes 18 are formed for mounting the vertical mounting plate on the bow. A horizontal mounting plate 20 is integral with the plate 16 and extends leftward at right angles thereto. Mounted on top of the front end of the horizontal mounting plate, i.e., the end away from the archer, is a front outer housing 22. As seen in this embodiment, the front outer housing is square or rectangular, with its front and back ends open, and is mounted on the horizontal mounting plate 20 by bolts or by any other convenient means. The front outer housing 22 has a top slot 24 in its top side which extends left and right, and a side slot 26 in its left side, which extends up and down.

Located in the interior of the front outer housing 22 is a square or rectangular front inner housing 28, which is square or rectangular and has all six sides closed, except as explained below. The front inner housing has threaded screw-receiving holes in its top and left sides adjacent to the top slot 24 and the side slot 26 of the front outer housing. An adjustment screw 30 extends from the hole in the top of the front inner housing to a knurled knob 32 above the top slot 24. A locking nut 34 is threaded onto the adjustment screw 30 between the top slot 24 and the top of the front inner housing 28.

A similar adjustment screw 36, knurled knob 38, and locking nut 40 are provided on the left side of the front inner housing 28 and front outer housing 22.

Figure 5:
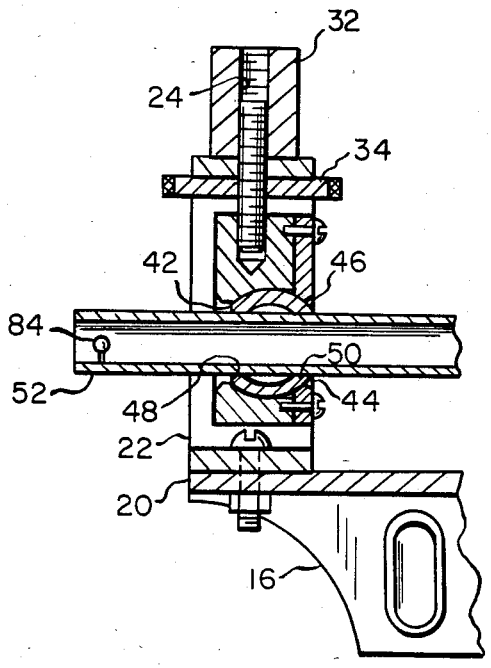
FIG. 5 is a cross-sectional view along line 5—5 of FIG. 4.

With particular reference to FIG. 5, an aperture 42 is formed in the front side of the front inner housing 28, and an aperture 44 is formed in the rear side of the front inner housing 28. The edges of these two apertures toward the interior of the front inner housing 28 are preferably chamfered. A hollow spherical bearing 46 is held by a friction fit between the apertures 42 and 44 for rotational movement. The bearing 46 has two diametrically opposed apertures 48 and 50. The apertures 48 and 50 are slightly smaller than the apertures 42, and may be lined up therewith to form an open channel between the front and rear sides of the front inner housing 28. A sighting tube 52 is held by a friction fit in the apertures 48 and 50.

The rear end of the sighting tube 52 is supported by an assembly identical to the above which is mounted on the rear end of the horizontal mounting plate 20. That is, a rear outer housing 54 is generally rectangular or square and has a top slot 56 and a side slot 58 on its left side. A square or rectangular rear inner housing 60 has screw-receiving threaded holes in its top and left sides. An adjusting screw 62 extends from the top of the rear inner housing 60 through the top slot 56 to a knurled knob 64. The adjusting screw 62 is locked by a locking nut 66 between the top surface of the rear inner housing and the top slot 56. An adjusting screw 68 extends from a threaded hole in the left side of the rear inner housing 60 through the side slot 58 to a knurled knob 70. The latter adjusting screw is locked by a locking nut 72. The front and rear ends of the rear inner housing 60 have front and rear apertures 74 and 76. The edges of these apertures toward the interior of the rear inner housing 60 are preferably chamfered. A spherical bearing 78 is held by a friction fit for rotational motion between the apertures 74 and 76. The spherical bearing has diametrically opposed front and rear apertures 80 and 82. The apertures 74 and 76 may be lined up with the apertures 80 and 82 to form a channel wherein the rear end of the sighting tube 52 is accommodated by a friction fit.

The sighting tube 52 has a sighting bead 84 mounted inside the tube near its forward end. It is flared slightly at its rearward end, as seen at 86.

By means of the knobs and adjusting screws, the two inner housings can be moved independently both vertically and horizontally within the respective outer housings. Thus, the sighting tube can be oriented at any desired angle. Tests with a 50-pound bow have shown that once adjusted, parallax is effectively eliminated up to about 30 yards. With a more powerful bow, particularly a compound bow, the sight should provide accuracy, simplicity of operation, and convenient adjustability, at any range. It can be used either horizontally or vertically, without any re-adjustment. Further, the open-tube design has been found to result in a better focus in low-light conditions such as dawn and dusk.

Although the invention has been discussed above with respect to a particular embodiment, it is to be understood that the invention is not limited to such embodiment. In particular, the invention can be adapted to either left- or right-hand bows, and to bows manufactured by different manufacturers. Other variations may occur to those skilled in the art within the scope of the invention, as defined by in the following claims.

I claim:

1. An archery sight comprising:

(a) frame means for attachment to a bow, said frame means having rectangular front and rear outer housings having vertical and horizontal portions;

(b) front and rear support means including rectangular front and rear inner housings mounted inward of the outer housings of said frame means, the inner and outer housings having corresponding parallel vertical and horizontal sides, said inner housings each having an aperture passing there through;

(c) sighting means comprising:

(i) a sighting tube having front and rear portions respectively supported on the front and rear inner housings of said front and rear support means; and (ii) front and rear spherical bearings rotatably accommodated in said respective apertures in said front and rear inner housings of said front and rear support means, each bearing having a channel for accommodating a respective portion of said sighting tube; and (d) adjustment means interconnecting the inner housings of the support means and the outer housings of the frame means for independently selectively orienting the front and rear ends of the sighting tube vertically and horizontally with respect to the frame means, said adjustment means including:

(i) two horizontal adjustment screws each interconnecting two corresponding vertical sides of the front and rear inner housings of said front and rear support means and said front and rear outer housings of said frame means; and (ii) two vertical adjustment screws each interconnecting two corresponding horizontal sides of the front and rear inner housings of said support means and said front and rear outer housings of said frame means.

2. An archery sight comprising:

(a) frame means for attachment to a bow, said frame means having front and rear outer housings having vertical and horizontal portions;

(b) front and rear support means including front and rear inner housings mounted inward of the outer housings of said frame means, the inner and outer housings having corresponding parallel vertical and horizontal sides, said inner housings each having an aperture passing there through;

(c) sighting means comprising:

(i) a sighting tube having front and rear portions respectively supported on the front and rear inner housings of said front and rear support means; and (ii) front and rear spherical bearings rotatably accommodated in said respective apertures in said front and rear inner housings of said front and rear support means, each bearing having a channel for accommodating a respective portion of said sighting tube; and (d) adjustment means interconnecting the inner housings of the support means and the outer housings of the frame means for independently selectively orienting the front and rear ends of the sighting tube vertically and horizontally with respect to the frame means.

3. The archery sight of claim 2 wherein said adjustment means includes:

(i) two horizontal adjustment screws each interconnecting two corresponding vertical sides of the front and rear inner housings of said front and rear support means and said front and rear outer housings of said frame means; and (ii) two vertical adjustment screws each interconnecting two corresponding horizontal sides of the front and rear inner housings of said support means and said front and rear outer housings of said frame means.

4. An archery sight comprising:

(a) frame means for attachment to a bow, said frame means having front and rear outer housings having substantially vertical and substantially horizontal portions;

(b) front and rear support means including front and rear inner housings mounted inward of the outer housings of said frame means, the inner and outer housings having corresponding substantially parallel vertical and horizontal sides, said inner housings each having an aperture passing there through;

(c) sighting means comprising:

(i) a sighting tube having front and rear portions respectively supported on the front and rear inner housings of said front and rear support means; and (ii) front and rear spherical bearings rotatably accommodated in said respective apertures in said front and rear inner housings of said front and rear support means, each bearing having a channel for accommodating a respective portion of said sighting tube; and (d) adjustment means interconnecting the inner housings of the support means and the outer housings of the frame means for independently selectively orienting the front and rear ends of the sighting tube vertically and horizontally with respect to the frame means.

5. The archery sight of claim 4 wherein said adjustment means includes:

(i) two horizontal adjustment screws each interconnecting two corresponding substantially vertical sides of the front and rear inner housings of said front and rear support means and said front and rear outer housings of said frame means; and (ii) two vertical adjustment screws each interconnecting two corresponding substantially horizontal sides of the front and rear inner housings of said support means and said front and rear outer housings of said frame means.

* * * * *